US009323264B2

(12) United States Patent
Huang et al.

(10) Patent No.: US 9,323,264 B2
(45) Date of Patent: Apr. 26, 2016

(54) VOLTAGE REGULATOR APPARATUS WITH SENSING MODULES AND RELATED OPERATING METHOD THEREOF

(71) Applicants: San-Yueh Huang, Hsin-Chu (TW); Wei-Lun Chen, Hsin-Chu (TW); Xiao-Dong Fei, Hsin-Chu (TW)

(72) Inventors: San-Yueh Huang, Hsin-Chu (TW); Wei-Lun Chen, Hsin-Chu (TW); Xiao-Dong Fei, Hsin-Chu (TW)

(73) Assignee: Faraday Technology Corp., Science-Based Industrial Park, Hsin-Chu (TW)

( * ) Notice: Subject to any disclaimer, the term of this patent is extended or adjusted under 35 U.S.C. 154(b) by 277 days.

(21) Appl. No.: 14/205,328

(22) Filed: Mar. 11, 2014

(65) Prior Publication Data

US 2015/0123635 A1 May 7, 2015

(30) Foreign Application Priority Data

Nov. 5, 2013 (CN) ..... 2013 1 0540724

(51) Int. Cl.
*G05F 1/56* (2006.01)
*G05F 1/575* (2006.01)

(52) U.S. Cl.
CPC ..... *G05F 1/575* (2013.01)

(58) Field of Classification Search
CPC ..... G05F 1/56; G05F 1/562; G05F 1/565; G05F 1/575
USPC ..... 323/273, 274, 275, 280, 281
See application file for complete search history.

(56) References Cited

U.S. PATENT DOCUMENTS

| | | | | |
|---|---|---|---|---|
| 7,502,719 | B2 | 3/2009 | Moraveji | |
| 8,344,713 | B2 | 1/2013 | Shrivas | |
| 8,493,043 | B2 | 7/2013 | Le et al. | |
| 8,648,578 | B2 | 2/2014 | Zhao | |
| 2002/0136065 | A1* | 9/2002 | Messager | G05F 1/565 365/189.09 |
| 2005/0046405 | A1* | 3/2005 | Trafton | G05F 1/56 323/308 |
| 2010/0127688 | A1* | 5/2010 | Konishi | G05F 1/56 323/312 |
| 2011/0156671 | A1 | 6/2011 | Gakhar | |
| 2011/0181259 | A1* | 7/2011 | Shen | G05F 1/575 323/282 |
| 2013/0119954 | A1 | 5/2013 | Lo | |
| 2015/0123635 | A1* | 5/2015 | Huang | G05F 1/575 323/281 |

FOREIGN PATENT DOCUMENTS

| | | | |
|---|---|---|---|
| CN | 1740937 | A | 3/2006 |
| CN | 101231535 | A | 7/2008 |
| CN | 101398694 | A | 4/2009 |
| CN | 101943925 | A | 1/2011 |

(Continued)

*Primary Examiner* — Jeffrey Sterrett
(74) *Attorney, Agent, or Firm* — Winston Hsu; Scott Margo

(57) ABSTRACT

A voltage regulator apparatus and an associated method are provided, where the voltage regulator apparatus includes: a voltage regulator module for regulating an input voltage according to a bandgap reference voltage to generate an output voltage; and a plurality of sensing modules. Ina situation where the output voltage abruptly decreases, a sensing module reduces, based on a variation amount of the output voltage, a decrement of the output voltage. In a situation where the output voltage abruptly increases, another sensing module reduces, based on another variation amount of the output voltage, an increment of the output voltage. In addition, yet another sensing module senses variation of the output voltage, converts the variation of the output voltage into a current signal, and applies the current signal to a control terminal within the voltage regulator module to indirectly control the output voltage.

20 Claims, 5 Drawing Sheets

(56) References Cited

FOREIGN PATENT DOCUMENTS

| | | | |
|---|---|---|---|
| CN | 102385410 | A | 3/2012 |
| CN | 102830742 | A | 12/2012 |
| CN | 103324237 | A | 9/2013 |
| EP | 1 065 580 | A1 | 1/2001 |
| JP | 2002189522 | | 7/2002 |
| TW | 200836038 | | 9/2008 |
| TW | 201303545 | | 1/2013 |

* cited by examiner

VOLTAGE REGULATOR APPARATUS WITH SENSING MODULES AND RELATED OPERATING METHOD THEREOF

BACKGROUND OF THE INVENTION

1. Field of the Invention

The present invention relates to controlling a low dropout (LDO) voltage regulator with fast transient response, and more particularly, to a voltage regulator apparatus and a related method.

2. Description of the Prior Art

As the operation efficiency of prior art voltage regulators is not good enough, prior art techniques have provided some solutions to improve the operation efficiency of voltage regulators. However, some problems are caused by these conventional solutions. For example, a prior art solution requires many additional paths configured in a traditional voltage regulator, where these additional paths are configured with additional elements, respectively. This results in a significant increase of the chip area. For another example, another related art solution makes the structure of a traditional voltage regulator too complicated without remarkably improving the performance of the voltage regulator. Hence, there is a need for a novel method to improve the control of the voltage regulator, to increase the overall performance without introducing any side effect.

SUMMARY OF THE INVENTION

Hence, one objective of the present invention is to provide a voltage regulator apparatus and a related method, to solve the aforementioned problems.

Another objective of the present invention is to provide a voltage regulator apparatus and a related method, to improve the operation performance of a voltage regulator.

According to at least one preferred embodiment, a voltage regulator apparatus is provided. The voltage regulator apparatus includes a bandgap reference circuit, a voltage regulator module, a first sensing module, a second sensing module and a third sensing module. The bandgap reference circuit is arranged for generating a bandgap reference voltage. The voltage regulator module is coupled to the bandgap reference circuit, and the voltage regulator module is arranged for regulating an input voltage according to the bandgap reference voltage to generate an output voltage. The first sensing module is coupled to the voltage regulator module, and the first sensing module is arranged for sensing a variation of the output voltage to selectively control the output voltage, wherein when the output voltage abruptly decreases, the first sensing module reduces a decrement of the output voltage based on a variation amount of the output voltage. The second sensing module is coupled to the voltage regulator module, and the second sensing module is arranged for sensing the variation of the output voltage, converting the variation of the output voltage into a current signal, and applying the current signal to a control terminal within the voltage regulator module, to indirectly control the output voltage. The third sensing module is coupled to the voltage regulator module, and the third sensing module is arranged for sensing a variation of the output voltage to selectively control the output voltage, wherein when the output voltage abruptly increases, the third sensing module reduces an increment of the output voltage based on another variation amount of the output voltage.

Besides providing the above voltage regulator apparatus, the present invention also correspondingly provides a method for operating the voltage regulator apparatus. The method includes following steps: using a bandgap reference circuit of the voltage regulator apparatus to generate a bandgap reference voltage, and using a voltage regulator module of the voltage regulator apparatus to regulate an input voltage according to the bandgap reference voltage to generate an output voltage; and sensing a variation of the output voltage to selectively control the output voltage. The step of sensing the variation of the output voltage to selectively control the output voltage further comprises: when the output voltage abruptly decreases, using a first sensing module of the voltage regulator apparatus to reduce a decrement of the output voltage based on a variation amount of the output voltage; when the output voltage abruptly increases, using a third sensing module of the voltage regulator apparatus to reduce an increment of the output voltage based on another variation amount of the output voltage; and using a second sensing module of the voltage regulator apparatus to sense the variation of the output voltage, convert the variation of the output voltage into a current signal, and apply the current signal to a control terminal within the voltage regulator module, to indirectly control the output voltage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
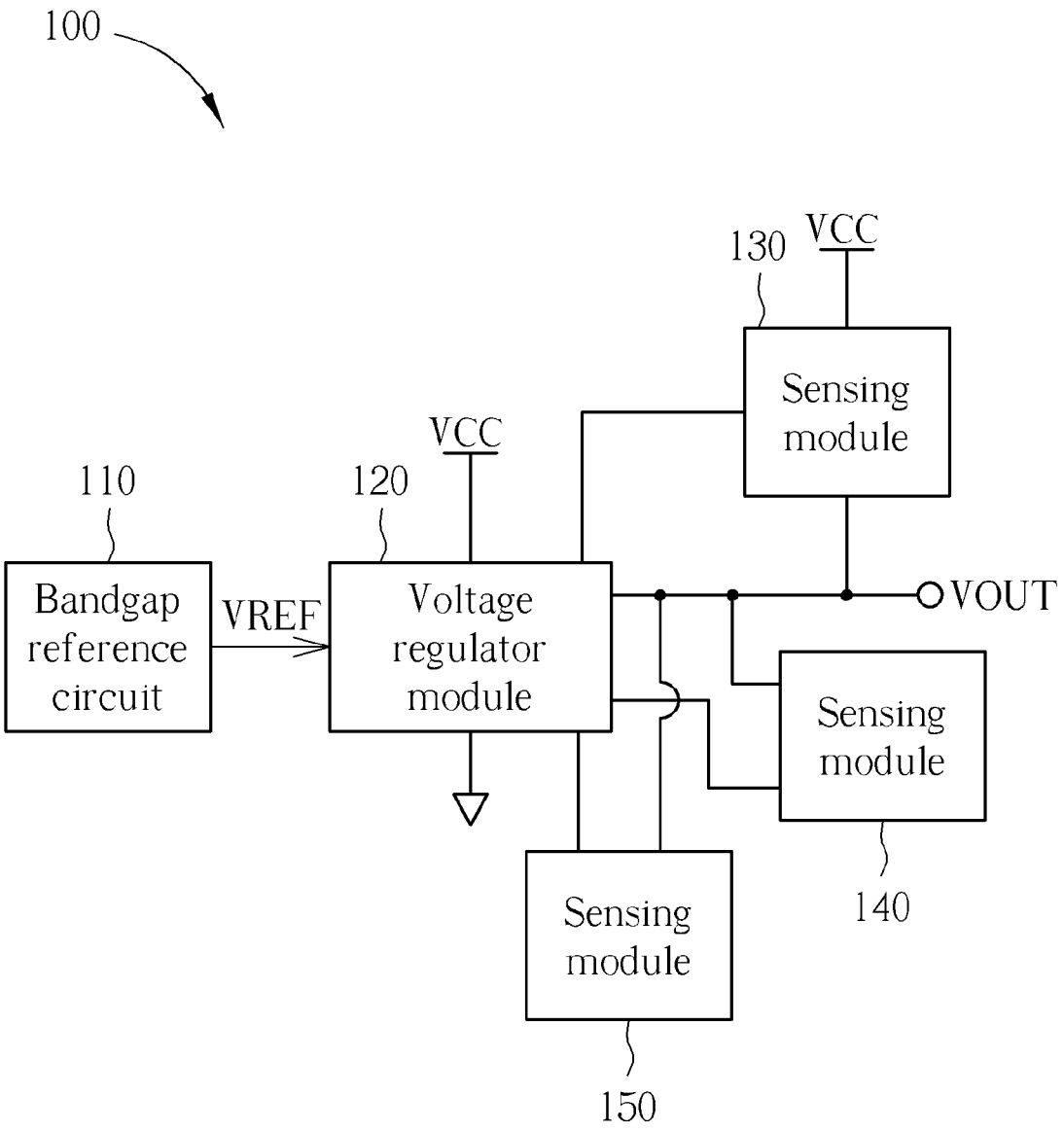
FIG. 1 is a diagram illustrating a voltage regulator apparatus according to a first embodiment of the present invention.

Please refer to FIG. 1, which is a diagram illustrating a voltage regulator apparatus 100 according to a first embodiment of the present invention. The voltage regulator apparatus 100 includes a bandgap reference circuit 110, a voltage regulator module 120 coupled to the bandgap reference circuit 110, and a plurality of sensing modules 130, 140 and 150 coupled to the voltage regulator module 120. The bandgap reference circuit 110 is arranged for generating a bandgap reference voltage VREF. The voltage regulator module 120 is arranged for regulating an input voltage VCC according to the bandgap reference voltage VREF and accordingly generating an output voltage $V_{OUT}$ at an output terminal VOUT of the voltage regulator module 120. More particularly, the sensing module 130 is used to sense a variation of the output voltage $V_{OUT}$ to selectively control the output voltage $V_{OUT}$, wherein when the output voltage $V_{OUT}$ abruptly decreases, the sensing module 130 reduces a decrement of the output voltage $V_{OUT}$ based on a variation amount of the output voltage $V_{OUT}$.

Further, the sensing module 140 is used to sense the variation of the output voltage $V_{OUT}$, and then convert the variation of the output voltage $V_{OUT}$ into a current signal and further apply the current signal to a control terminal PGATE (not shown in FIG. 1) within the voltage regulator module 120, in order to indirectly control the output voltage $V_{OUT}$. Moreover, the sensing module 150 is arranged for sensing a variation of the output voltage $V_{OUT}$ to selectively control the output voltage $V_{OUT}$, wherein when the output voltage $V_{OUT}$ abruptly increases, the sensing module 150 reduces an increment of the output voltage $V_{OUT}$ based on another variation amount of the output voltage $V_{OUT}$.

Figure 2:
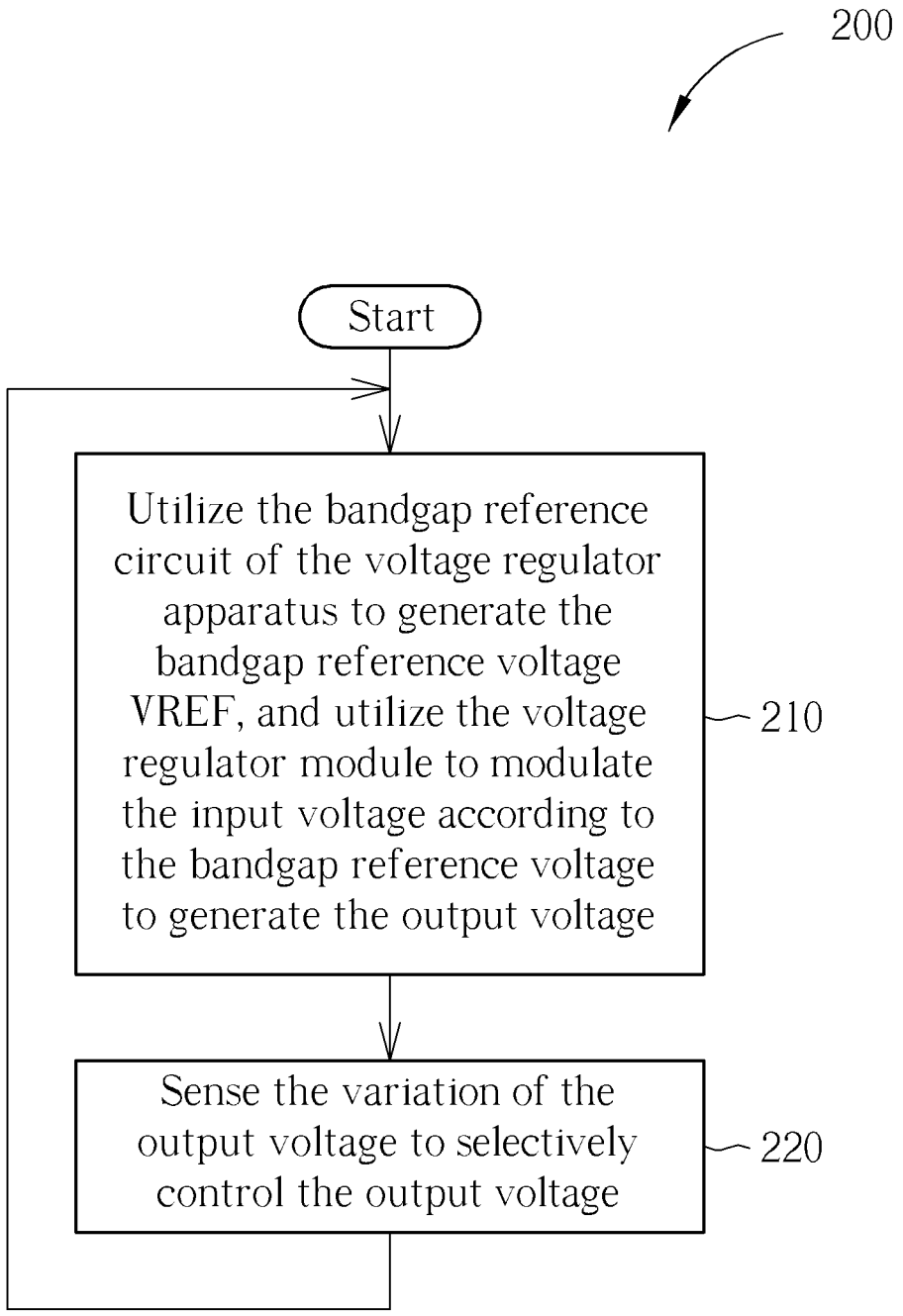
FIG. 2 is a flowchart illustrating an operation method of the voltage regulator apparatus according to an embodiment of the present invention.

Please refer to FIG. 2, which is a flowchart illustrating an operation method 200 of a voltage regulator apparatus according to an embodiment of the present invention. The operation method 200 may be applied to the voltage regulator apparatus 100 shown in FIG. 1, and more particularly, to the sensing modules 130, 140 and 150. The operation method 200 is described as follows.

In step 210, the voltage regulator apparatus 100 utilizes the bandgap reference circuit 110 of the voltage regulator apparatus 100 to generate the bandgap reference voltage VREF, and utilizes the voltage regulator module 120 to generate the output voltage $V_{OUT}$ by regulating the input voltage VCC according to the bandgap reference voltage VREF.

In step 220, the voltage regulator apparatus 100 utilizes the sensing modules 130, 140 and 150 to sense the variation of the output voltage $V_{OUT}$ to selectively control the output voltage $V_{OUT}$. For example, when the output voltage $V_{OUT}$ abruptly decreases, the voltage regulator apparatus 100 utilizes the sensing module 130 to reduce the decrement of the output voltage $V_{OUT}$ based on a variation amount of the output voltage $V_{OUT}$. For another example, when the output voltage $V_{OUT}$ abruptly increases, the bandgap reference circuit 110 utilizes the sensing module 150 to reduce the increment of the output voltage $V_{OUT}$ based on another variation amount of the output voltage $V_{OUT}$. For yet another example, the voltage regulator apparatus 100 utilizes the sensing module 140 to sense the variation of the output voltage $V_{OUT}$, convert the variation of the output voltage $V_{OUT}$ into the current signal, and apply the current signal to the control terminal PGATE within the voltage regulator module 120, to indirectly control the output voltage.

More particularly, when the output voltage $V_{OUT}$ abruptly decreases, the voltage regulator apparatus 100 utilizes the sensing module 130 to obtain an instant current from a voltage source of the input voltage VCC based on the variation amount of the output voltage $V_{OUT}$ and add the instant current to the output terminal VOUT of the voltage regulator module 120, to reduce the decrement of the output voltage $V_{OUT}$, wherein the voltage source generates the input voltage VCC, and the output terminal VOUT of the voltage regulator module 102 outputs the output voltage $V_{OUT}$. Further, when the output voltage $V_{OUT}$ abruptly increases, the voltage regulator apparatus 100 utilizes the sensing module 150 to obtain another instant current from the output terminal VOUT of the voltage regulator module 120 based on the other variation amount of the output voltage $V_{OUT}$ and release the other instant current to a grounding terminal, to reduce the increment of the output voltage $V_{OUT}$ Please note that the operation procedure including steps 210 and 220 depicted in FIG. 2 is merely for illustrative purposes, and is not used to limit the present invention. According to a modification of the present embodiment, the operation procedure can be modified. For example, at least a portion (i.e., part or all) of the operation in step 210 and/or at least a portion (i.e., part or all) of the operation in step 220 can be performed repeatedly as long as the present invention can be implemented. For another example, at least a portion (i.e., part or all) of the operation in step 210 and at least a portion (i.e., part or all) of the operation in step 220 can be performed repeatedly as long as the present invention can be implemented.

Based on the structure shown in FIG. 1, the voltage regulator apparatus 100 and the related method do not need additional paths and additional elements on these paths, thus avoiding a significant increase of the chip area. Hence, the present invention can avoid the problems of the prior art techniques. More particularly, the sensing modules 130, 140 and 150 may have the feedback control functions for accurately correcting the aforementioned output voltage $V_{oUT}$. Further, compared with the prior art designs, the voltage regulator apparatus 100 and the related method of the present invention can be easily implemented and have fast transient response. Hence, the present invention can concretely increase the overall performance and also save the related production cost.

Figure 3:
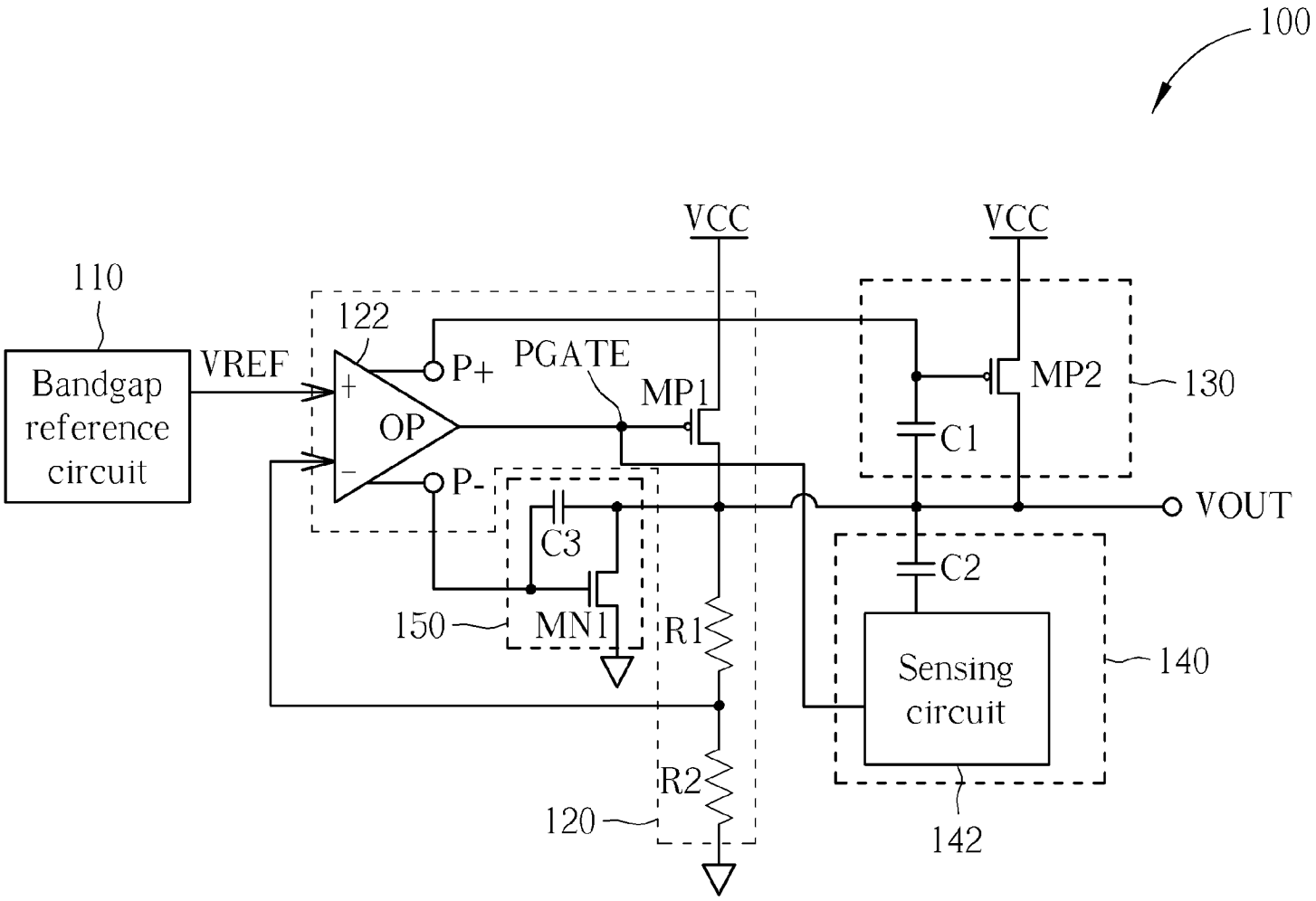
FIG. 3 is a diagram illustrating a control scheme involved with the operation method shown in FIG. 2 according to an embodiment of present invention.

Please refer to FIG. 3, which is a diagram illustrating a control scheme involved with the operation method 200 shown in FIG. 2 according to an embodiment of present invention. According to this embodiment, the voltage regulator module 120 includes an operational amplifier (Op-Amp) 122 (for brevity, the operational amplifier 122 is denoted as "OP" in FIG. 3) coupled to the bandgap reference circuit 110, a transistor such as a P-type metal oxide semiconductor field effect transistor (PMOSFET) MP1 coupled to the operational amplifier 122, the input voltage VCC and the output terminal VOUT, and a voltage dividing circuit coupled to the output terminal VOUT, the transistor and the operational amplifier 122, wherein the voltage dividing circuit includes a plurality of resistors R1 and R2. The operational amplifier 122 compares a divided voltage with the bandgap reference voltage VREF, to generate a control signal. The transistor such as the PMOSFET MP1 is selectively turned on based on the control signal, to regulate the input voltage VCC to generate the output voltage $V_{OUT}$. Further, the voltage dividing circuit generates the divided voltage corresponding to the output voltage $V_{OUT}$, wherein the ratio of the divided voltage to the output voltage $V_{OUT}$ is determined by the resistance values of the resistors R1 and R2. Moreover, the sensing modules 130 and 150 are coupled to a plurality of power terminals P+ and P− of the operational amplifier 122 to receive a positive power signal and a negative power signal of the operational amplifier 122, respectively, for sensing operations. In practice, the aforementioned control terminal PGATE is the control terminal in the transistor for receiving the control signal, especially the gate of the PMOSFET MP1, wherein the source of the PMOSFET MP1 is coupled to the input voltage VCC, and the drain of the PMOSFET MP1 is coupled to the output terminal VOUT.

As shown in FIG. 3, the sensing module 130 includes a capacitor C1 having a first terminal and a second terminal (in this embodiment, the upper terminal and the lower terminal of the capacitor C1). The first terminal of the capacitor C1 is coupled to the power terminal P+ of the operational amplifier 122. The second terminal of the capacitor C1 is coupled to the output terminal VOUT of the voltage regulator module 122. The sensing module 130 also includes a PMOSFET PM2 having a gate, a drain and a source. The gate of the PMOSFET PM2 is coupled to the first terminal of the capacitor C1, the drain of the PMOSFET PM2 is coupled to the second terminal of the capacitor C1, and the source of the PMOSFET PM2 is coupled to the input voltage VCC. More particularly, in step 220, when the output voltage $V_{OUT}$ abruptly decreases, the voltage regulator apparatus 100 utilizes the capacitor C1 to couple the output voltage $V_{OUT}$ to the gate of the PMOSFET, and utilizes the other PMOSFET MP2 to obtain the instant current from the voltage source of the input voltage VCC and apply the instant current to the output terminal VOUT to reduce the decrement of the output voltage $V_{OUT}$.

Further, the sensing module 140 includes a capacitor C2 and a sensing circuit 142. The capacitor C2 has a first terminal and a second terminal (in this embodiment, the upper terminal and the lower terminal of the capacitor C2). The first terminal of the capacitor C2 is coupled to the output terminal VOUT. The sensing circuit 142 is coupled to the second terminal of the capacitor C2 and the gate of the PMOSFET MP1. More particularly, in step 220, when the output voltage $V_{OUT}$ abruptly increases or decreases, the voltage regulator apparatus 100 utilizes the second capacitor C2 to couple the output voltage $V_{OUT}$ to the sensing circuit 142, and utilizes the sensing circuit 142 to convert the output voltage $V_{OUT}$ into the current signal, to increase the response speed of the PMOSFET MP1.

Further, the sensing module 150 includes a capacitor C3 and an N-type metal oxide semiconductor field effect transistor (NMOSFET) MN1. The capacitor C3 has a first terminal and a second terminal (in this embodiment, the left terminal and the right terminal of the capacitor C3). The first terminal of the capacitor C3 is coupled to the power terminal P− of the operational amplifier 122. The second terminal of the capacitor C3 is coupled to the output terminal VOUT. The NMOSFET MN1 has a gate, a drain and a source. The gate of the NMOSFET MN1 is coupled to the first terminal of the capacitor C3, the drain of the NMOSFET MN1 is coupled to the second terminal of the capacitor C3, and the source of the NMOSFET MN1 is coupled to the grounding terminal. More particularly, in step 220, when the output voltage $V_{OUT}$ abruptly increases, the voltage regulator apparatus 100 utilizes the second capacitor C3 to couple the output voltage $V_{OUT}$ to the gate of the NMOSFET MN1, and utilizes the NMOSFET MN1 to obtain another instant current from the output terminal VOUT and release the other instant current to the grounding terminal, to reduce the increment of the output voltage $V_{OUT}$.

Figure 4:
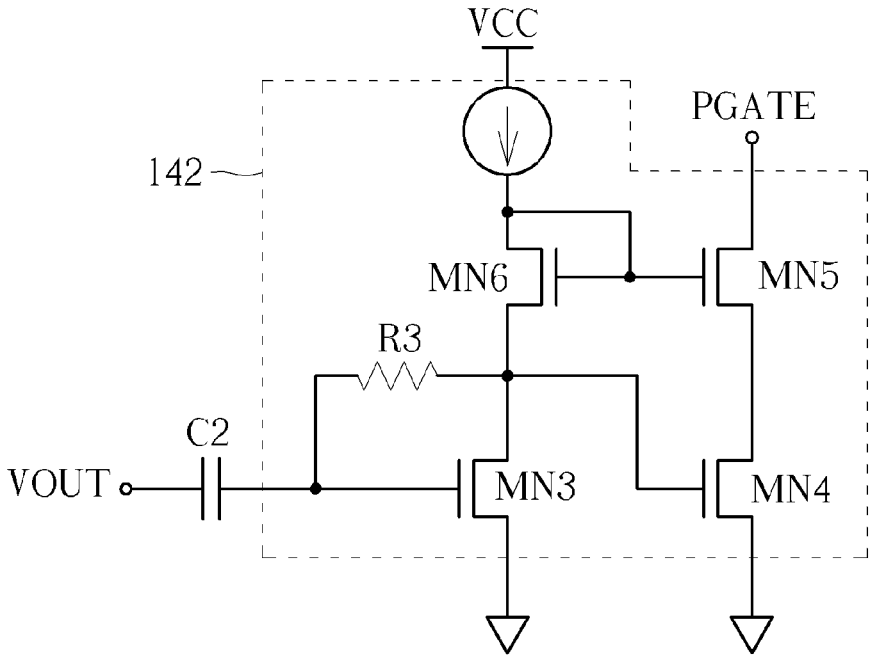
FIG. 4 is a diagram illustrating a control scheme involved with the operation method shown in FIG. 2 according to another embodiment of present invention.

Please refer to FIG. 4, which is a diagram illustrating a control scheme involved with the operation method 200 shown in FIG. 2 according to another embodiment of present invention. The capacitor C2 shown in the left-down corner in FIG. 4 and the capacitor C2 shown in FIG. 3 are the same element. The sensing circuit 142 includes a current source, an NMOSFET MN3, a resistor R3 and an NMOSFET MN4. In this embodiment, the current source is a constant current source arranged to generate a specific current for the sensing circuit 142, wherein an output terminal of the current source outputs the specific current. The NMOSFET MN3 has a gate, a drain and a source. The gate of the NMOSFET MN3 is coupled to the second terminal of the capacitor C2, the drain of the NMOSFET MN3 is coupled to the output terminal of the current source, and the source of the NMOSFET MN3 is coupled to ground. The resistor R3 has two terminals coupled to the gate and the drain of the NMOSFET MN3, respectively. The NMOSFET MN4 has a gate, a drain and a source. The gate of the NMOSFET MN4 is coupled to the drain of the NMOSFET MN3, the drain of the NMOSFET MN4 is coupled to the gate of the PMOSFET MP1, and the source of the NMOSFET MN4 is coupled to ground. Hence, in step 220, when the output voltage $V_{OUT}$ abruptly decreases or increases, the voltage regulator apparatus 100 utilizes the capacitor C2 to couple the output voltage $V_{OUT}$ to the gate of the NMOSFET MN3, and utilizes a common source structure formed by the NMOSFETs MN3 and MN4 to amplify a coupling voltage obtained from the capacitor C2, to increase the response speed of the PMOSFET MP1.

More particularly, the sensing circuit 142 may further include an NMOSFET MN5. The NMOSFET MN5 has a gate, a drain and a source. The gate of the NMOSFET MN5 is coupled to the output terminal of the current source, the drain of the NMOSFET MN5 is coupled to the gate of the PMOSFET MP1 (the control terminal PGATE in this embodiment), and the source of the NMOSFET MN5 is coupled to the drain of the NMOSFET MN4, wherein the drain of the NMOSFET MN4 is coupled to the gate of the PMOSFET MP1 through the NMOSFET MP5. Hence, in step 220, when the output voltage $V_{OUT}$ abruptly increases or decreases, the voltage regulator apparatus 100 utilizes the connection relationship of the gate of the NMOSFET MN5 in the sensing circuit 142 to convert the variation of the voltage source into the current signal.

As shown in FIG. 4, the sensing circuit 142 may further include a NMOSFET MN6. The NMOSFET MN6 has a gate, a drain and a source. The gate of the NMOSFET MN6 is coupled to the gate of NMOSFET MN5, the drain of the NMOSFET MN6 is coupled to the output terminal of the current source, and the source of the NMOSFET MN6 is coupled to the drain of the NMOSFET MN3, wherein the gate of the NMOSFET MN6 is short-circuited to the drain of the NMOSFET MN6, and the drain of the NMOSFET MN3 is coupled to the output terminal of the current source through the NMOSFET MN6. Please note that, the voltage regulator apparatus 100 may utilize the common gate structure formed by the NMOFET MN6 and the NMOFET MN5 to convert the output voltage $V_{OUT}$ into the current signal. Since the current signal corresponds to the variation of the output voltage $V_{OUT}$, the voltage regulator apparatus 100 may utilize the sensing circuit 142 to increase the response speed of the PMOSFET MP1 for reducing the variation of the output voltage VOUT when the output voltage $V_{OUT}$ abruptly decreases or increases. Further, the structure shown in FIG. 4 utilizes the NMOSFET MN6 to provide a bias point for the NMOSFET MN5. However, it is merely for illustration, not a limitation to the present invention. According to some modifications of this embodiment, the sensing circuit 142 may omit the NMOSFET MN6. For example, the NMOSFET MN6 can be replaced with a resistor.

Figure 5:
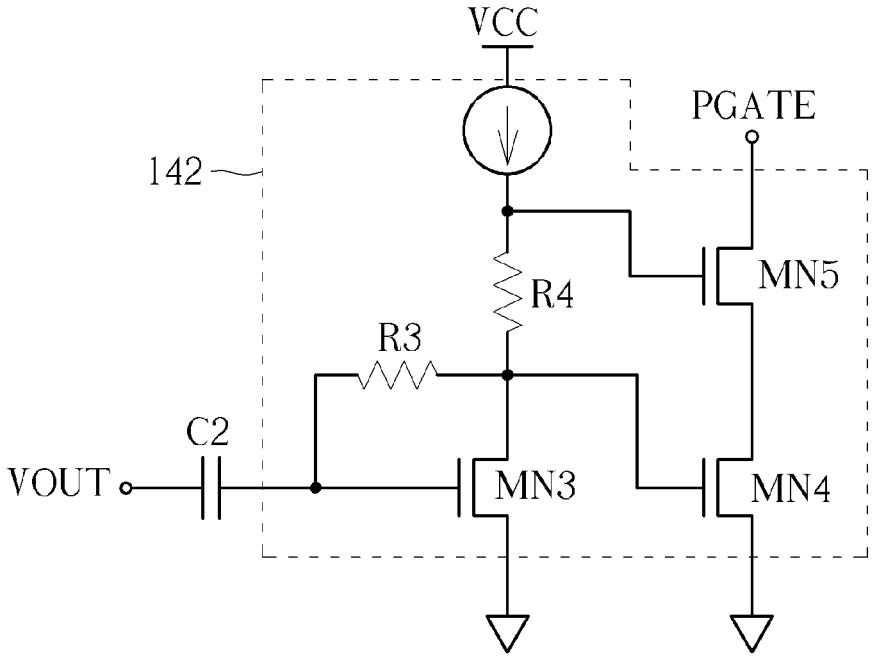
FIG. 5 is a diagram illustrating a control scheme involved with the operation method shown in FIG. 2 according to yet another embodiment of present invention.

Please refer to FIG. 5, which is a diagram illustrating a control scheme involved with the operation method 200 shown in FIG. 2 according to yet another embodiment of present invention. The capacitor C2 shown in the left-down corner in FIG. 5 and the capacitor C2 shown in FIG. 3 are the same element. As shown in FIG. 5, the sensing circuit 142 may further include a resistor R4 having two terminals coupled to the output terminal of the current source and the drain of the NMOSFET MN3, respectively, wherein the drain of the NMOSFET MN3 is coupled to the output terminal of the current source through the resistor R4. Hence, the voltage regulator apparatus 100 may utilize the connection relationship of the resistor R4 and the NMOSFET MN5 in the sensing circuit 142 to convert the variation of the output voltage $V_{OUT}$ into the current signal. The rest of this embodiment is similar to those of the previous embodiments, and further description thereof will be omitted here for brevity.

Figure 6:
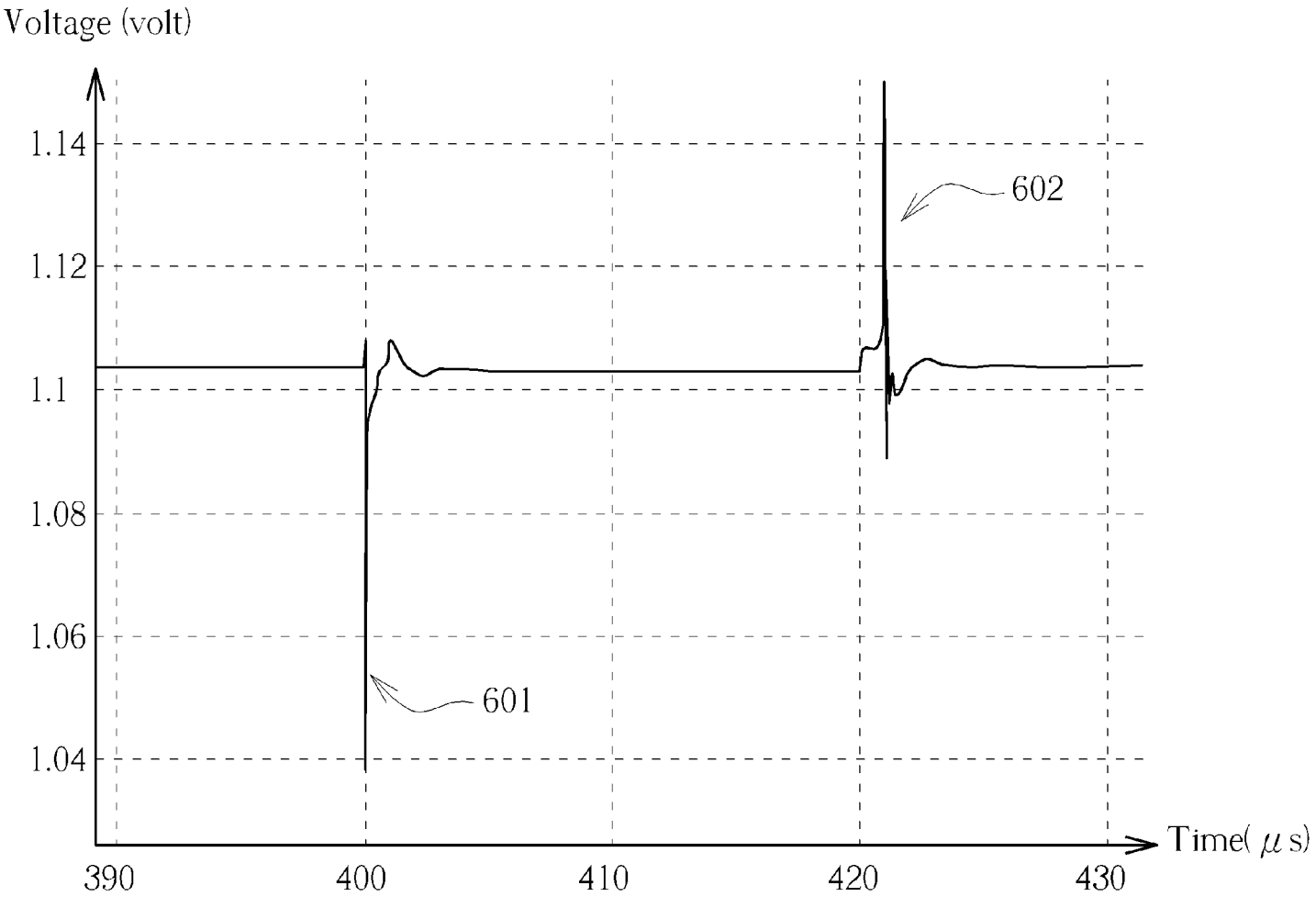
FIG. 6 is a diagram illustrating an output voltage curve of the operation method shown in FIG. 2 according to an embodiment of present invention.

Please refer to FIG. 6, which is a diagram illustrating an output voltage curve of the operation method 200 shown in FIG. 2 according to an embodiment of present invention. In this embodiment, once the load current varies, the output voltage $V_{OUT}$ will vary accordingly. For example, when the load current abruptly changes from a small current value to a large current value, the output voltage $V_{OUT}$ will abruptly drop. As shown in the partial curve 601, through performing the operation method 200, the output voltage $V_{OUT}$ will be pushed up to the original level, thus reducing the decrement of the output voltage $V_{OUT}$. Further, when the load current abruptly changes from a large current value to a small current value, the output voltage $V_{OUT}$ will abruptly increase. As shown in the partial curve 602, through performing the operation method 200, the output voltage $V_{OUT}$ will be pulled down to the original level, thus reducing the increment of the output voltage $V_{OUT}$. Hence, compared with the prior art designs, the voltage regulator apparatus 100 and the related method of the present invention indeed make the output voltage $V_{OUT}$ more stable.

Those skilled in the art will readily observe that numerous modifications and alterations of the apparatus and method may be made while retaining the teachings of the invention. Accordingly, the above disclosure should be construed as limited only by the metes and bounds of the appended claims.

What is claimed is:

1. A voltage regulator apparatus, comprising:

a bandgap reference circuit, arranged for generating a bandgap reference voltage;

a voltage regulator module, coupled to the bandgap reference circuit, the voltage regulator module arranged for regulating an input voltage according to the bandgap reference voltage to generate an output voltage;

a first sensing module, coupled to the voltage regulator module, the first sensing module arranged for sensing a variation of the output voltage to selectively control the output voltage, wherein when the output voltage abruptly decreases, the first sensing module reduces a decrement of the output voltage based on a variation amount of the output voltage;

a second sensing module, coupled to the voltage regulator module, the second sensing module arranged for sensing the variation of the output voltage, converting the variation of the output voltage into a current signal, and applying the current signal to a control terminal within the voltage regulator module, to indirectly control the output voltage; and a third sensing module, coupled to the voltage regulator module, the third sensing module arranged for sensing a variation of the output voltage to selectively control the output voltage, wherein when the output voltage abruptly increases, the third sensing module reduces an increment of the output voltage based on another variation amount of the output voltage.

2. The voltage regulator apparatus of claim 1, wherein when the output voltage abruptly decreases, the first sensing module obtains an instant current from a voltage source of the input voltage based on the variation amount of the output voltage and applies the instant current to an output terminal of the voltage regulator module, to reduce the decrement of the output voltage, where the voltage source generates the input voltage, and the output terminal of the voltage regulator module outputs the output voltage; and when the output voltage abruptly increases, the third sensing module obtains another instant current from the output terminal of the voltage regulator module based on the other variation amount of the output voltage and releases the other instant current to a grounding terminal, to reduce the increment of the output voltage.

3. The voltage regulator apparatus of claim 2, wherein the voltage regulator module comprises:

an operational amplifier, coupled to the bandgap reference circuit, the operational amplifier arranged for comparing a divided voltage with the bandgap reference voltage to generate a control signal;

a transistor, coupled to the operational amplifier, the input voltage, and the output terminal of the voltage regulator module, wherein the transistor is selectively turned on based on the control signal for regulating the input voltage to generate the output voltage; and a voltage dividing circuit, coupled to the output terminal of the voltage regulator module, the transistor, and the operational amplifier, the voltage dividing circuit arranged for generating the divided voltage corresponding to the output voltage, wherein the voltage dividing circuit comprises a plurality of resistors, and a ratio of the divided voltage to the output voltage is determined based on resistance values of the plurality of resistors;

wherein the first sensing module is coupled to a first power terminal of the operational amplifier, and the third sensing module is coupled to a second power terminal of the operational amplifier; and the control terminal within the voltage regulator module is a control terminal of the transistor that is arranged for receiving the control signal.

4. The voltage regulator apparatus of claim 3, wherein the transistor is a P-type metal oxide semiconductor field effect transistor (PMOSFET); and the control terminal within the voltage regulator module is a gate of the PMOSFET, a source of the PMOSFET is coupled to the input voltage, and a drain of the PMOSFET is coupled to the output terminal of the voltage regulator module.

5. The voltage regulator apparatus of claim 4, wherein the first sensing module comprises:

a first capacitor, having a first terminal and a second terminal, wherein the first terminal of the first capacitor is coupled to the first power terminal of the operational amplifier, and the second terminal of the first capacitor is coupled to the output terminal of the voltage regulator module; and another PMOSFET, having a gate, a drain and a source, wherein the gate of the other PMOSFET is coupled to the first terminal of the first capacitor, the drain of the other PMOSFET is coupled to the second terminal of the first capacitor, and the source of the other PMOSFET is coupled to the input voltage;

wherein when the output voltage abruptly decreases, the first capacitor couples the output voltage to the gate of the other PMOSFET, and the other PMOSFET obtains the instant current from the voltage source of the input voltage and applies the instant current to the output terminal of the voltage regulator module, to reduce the decrement of the output voltage.

6. The voltage regulator apparatus of claim 4, wherein the second sensing module comprises:

a second capacitor, having a first terminal coupled to the output terminal of the voltage regulator module; and a sensing circuit, coupled to a second terminal of the second capacitor and the gate of the PMOSFET;

wherein when the output voltage abruptly increases or decreases, the second capacitor couples the output voltage to the sensing circuit, and the sensing circuit converts the variation of the output voltage into the current signal, to increase a response speed of the PMOSFET.

7. The voltage regulator apparatus of claim 6, wherein the sensing circuit comprises:

a current source, arranged for generating a specific current for the sensing circuit, wherein an output terminal of the current source outputs the specific current;

a first N-type metal oxide semiconductor field effect transistor (NMOSFET), having a gate, a drain and a source, wherein the gate of the first NMOSFET is coupled to the second terminal of the second capacitor, the drain of the first NMOSFET is coupled to the output terminal of the current source, and the source of the first NMOSFET is coupled to ground;

a resistor, having two terminals coupled to the gate and the drain of the first NMOSFET, respectively; and a second NMOSFET, having a gate, a drain and a source, wherein the gate of the second NMOSFET is coupled to the drain of the first NMOSFET, the drain of the second NMOSFET is coupled to the gate of the PMOSFET, and the source of the second NMOSFET is coupled to ground;

wherein when the output voltage abruptly decreases or increases, the voltage regulator apparatus utilizes the second capacitor to couple the output voltage to the gate of the first NMOSFET, and utilizes a common source structure formed by the first NMOSFET and the second NMOSFET to amplify a coupling voltage obtained from the second capacitor, to increase the response speed of the PMOSFET.

8. The voltage regulator apparatus of claim 7, wherein the sensing circuit further comprises:

a third NMOSFET, having a gate, a drain and a source, wherein the gate of the third NMOSFET is coupled to the output terminal of the current source, the drain of the third NMOSFET is coupled to the gate of the PMOSFET, and the source of the third NMOSFET is coupled to the drain of the second NMOSFET;

wherein the drain of the second NMOSFET is coupled to the gate of the PMOSFET through the third NMOSFET; and when the output voltage abruptly increases or decreases, the voltage regulator apparatus utilizes a connection relationship of the gate of the third NMOSPET in the sensing circuit to convert the variation of the output voltage into the current signal.

9. The voltage regulator apparatus of claim 8, wherein the sensing circuit further comprises:

a fourth NMOSFET, having a gate, a drain and a source, wherein the gate of the fourth NMOSFET is coupled to the gate of third NMOSFET, the drain of the fourth NMOSFET is coupled to the output terminal of the current source, the source of the fourth NMOSFET is coupled to the drain of the first NMOSFET, and the gate of the fourth NMOSFET is short-circuited to the drain of the fourth NMOSFET;

wherein the drain of the first NMOSFET is coupled to the output terminal of the current source through the fourth NMOSFET.

10. The voltage regulator apparatus of claim 8, wherein the sensing circuit further comprises:

another resistor, having two terminals coupled to the output terminal of the current source and the drain of the first NMOSFET, respectively;

wherein the drain of the first NMOSFET is coupled to the output terminal of the current source through the other resistor.

11. The voltage regulator apparatus of claim 4, wherein the third sensing module comprises:

a third capacitor, having a first terminal and a second terminal coupled to the second power terminal of the operation amplifier and the output terminal of the voltage regulator module, respectively; and an N-type metal oxide semiconductor field effect transistor (NMOSFET), having a gate, a drain and a source, wherein the gate of the NMOSFET is coupled to the first terminal of the third capacitor, the drain of the NMOSFET is coupled to the second terminal of the third capacitor, and the source of the NMOSFET is coupled to the grounding terminal;

wherein when the output voltage abruptly increases, the third capacitor couples the output voltage to the gate of the NMOSFET, and the NMOSFET obtains the other instant current from the output terminal of the voltage regulator module and releases the other instant current to the grounding terminal, to reduce the increment of the output voltage.

12. An operating method of a voltage regulator apparatus, the method comprising following steps:

using a bandgap reference circuit of the voltage regulator apparatus to generate a bandgap reference voltage, and using a voltage regulator module of the voltage regulator apparatus to regulate an input voltage according to the bandgap reference voltage to generate an output voltage; and sensing a variation of the output voltage to selectively control the output voltage, wherein the step of sensing the variation of the output voltage to selectively control the output voltage further comprises:

when the output voltage abruptly decreases, using a first sensing module of the voltage regulator apparatus to reduce a decrement of the output voltage based on a variation amount of the output voltage;

when the output voltage abruptly increases, using a third sensing module of the voltage regulator apparatus to reduce an increment of the output voltage based on another variation amount of the output voltage; and using a second sensing module of the voltage regulator apparatus to sense the variation of the output voltage, convert the variation of the output voltage into a current signal, and apply the current signal to a control terminal within the voltage regulator module, to indirectly control the output voltage.

13. The operating method of claim 12, wherein the step of sensing the variation of the output voltage to selectively control the output voltage further comprises:

when the output voltage abruptly decreases, using the first sensing module to obtain an instant current from a voltage source of the input voltage based on the variation amount of the output voltage and applying the instant current to an output terminal of the voltage regulator module, to reduce the decrement of the output voltage, where the voltage source generates the input voltage, and the output terminal of the voltage regulator module outputs the output voltage; and when the output voltage abruptly increases, using the third sensing module to obtain another instant current from the output terminal of the voltage regulator module based on the other variation amount of the output voltage and releases the other instant current to a grounding terminal, to reduce the increment of the output voltage.

14. The operating method of claim 13, wherein the voltage regulator module comprises:

an operational amplifier, coupled to the bandgap reference circuit, the operational amplifier arranged for comparing a divided voltage with the bandgap reference voltage to generate a control signal;

a transistor, coupled to the operational amplifier, the input voltage, and the output terminal of the voltage regulator module, wherein the transistor is selectively turned on based on the control signal for regulating the input voltage to generate the output voltage; and a voltage dividing circuit, coupled to the output terminal of the voltage regulator module, the transistor, and the operational amplifier, the voltage dividing circuit arranged for generating the divided voltage corresponding to the output voltage, wherein the voltage dividing circuit comprises a plurality of resistors, and a ratio of the divided voltage to the output voltage is determined based on resistance values of the plurality of resistors;

wherein the first sensing module is coupled to a first power terminal of the operational amplifier, and the third sensing module is coupled to a second power terminal of the operational amplifier; and the control terminal within the voltage regulator module is a control terminal of the transistor that is arranged for receiving the control signal.

15. The operating method of claim 14, wherein the transistor is a P-type metal oxide semiconductor field effect transistor (PMOSFET); and the control terminal within the voltage regulator module is a gate of the PMOSFET, a source of the PMOSFET is coupled to the input voltage, and a drain of the PMOSFET is coupled to the output terminal of the voltage regulator module.

16. The operating method of claim 15, wherein the first sensing module comprises:

a first capacitor, having a first terminal and a second terminal, wherein the first terminal of the first capacitor is coupled to the first power terminal of the operational amplifier, and the second terminal of the first capacitor is coupled to the output terminal of the voltage regulator module; and another PMOSFET, having a gate, a drain and a source, wherein the gate of the other PMOSFET is coupled to the first terminal of the first capacitor, the drain of the other PMOSFET is coupled to the second terminal of the first capacitor, and the source of the other PMOSFET is coupled to the input voltage;

wherein the step of sensing the variation of the output voltage to selectively control the output voltage further comprises:

when the output voltage abruptly decreases, utilizing the first capacitor to couple the output voltage to the gate of the other PMOSFET, and utilizing the other PMOSFET to obtain the instant current from the voltage source of the input voltage and apply the instant current to the output terminal of the voltage regulator module, to reduce the decrement of the output voltage.

17. The operating method of claim 15, wherein the second sensing module comprises:

a second capacitor, having a first terminal coupled to the output terminal of the voltage regulator module; and a sensing circuit, coupled to a second terminal of the second capacitor and the gate of the PMOSFET;

wherein the step of sensing the variation of the output voltage to selectively control the output voltage further comprises:

when the output voltage abruptly increases or decreases, utilizing the second capacitor to couple the output voltage to the sensing circuit, and utilizing the sensing circuit to convert the variation of the output voltage into the current signal, to increase a response speed of the PMOSFET.

18. The operating method of claim 17, wherein the sensing circuit comprises:

a current source, arranged for generating a specific current for the sensing circuit, wherein an output terminal of the current source outputs the specific current;

a first N-type metal oxide semiconductor field effect transistor (NMOSFET), having a gate, a drain and a source, wherein the gate of the first NMOSFET is coupled to the second terminal of the second capacitor, the drain of the first NMOSFET is coupled to the output terminal of the current source, and the source of the first NMOSFET is coupled to ground;

a resistor, having two terminals coupled to the gate and the drain of the first NMOSFET, respectively; and a second NMOSFET, having a gate, a drain and a source, wherein the gate of the second NMOSFET is coupled to the drain of the first NMOSFET, the drain of the second NMOSFET is coupled to the gate of the PMOSFET, and the source of the second NMOSFET is coupled to ground;

wherein the step of sensing the variation of the output voltage to selectively control the output voltage further comprises:

when the output voltage abruptly decreases or increases, utilizing the second capacitor to couple the output voltage to the gate of the first NMOSFET, and utilizing a common source structure formed by the first NMOSFET and the second NMOSFET to amplify a coupling voltage obtained from the second capacitor, to increase the response speed of the PMOSFET.

19. The operating method of claim 18, wherein the sensing circuit further comprises:

a third NMOSFET, having a gate, a drain and a source, wherein the gate of the third NMOSFET is coupled to the output terminal of the current source, the drain of the third NMOSFET is coupled to the gate of the PMOSFET, and the source of the third NMOSFET is coupled to the drain of the second NMOSFET;

wherein the drain of the second NMOSFET is coupled to the gate of the PMOSFET through the third NMOSFET; and the step of sensing the variation of the output voltage to selectively control the output voltage further comprises:

when the output voltage abruptly increases or decreases, utilizing a connection relationship of the gate of the third NMOSPET in the sensing circuit to convert the variation of the voltage source into the current signal.

20. The operating method of claim 15, wherein the third sensing module comprises:

a third capacitor, having a first terminal and a second terminal coupled to the second power terminal of the operation amplifier and the output terminal of the voltage regulator module, respectively; and a NMOSFET, having a gate, a drain and a source, wherein the gate of the NMOSFET is coupled to the first terminal of the third capacitor, the drain of the NMOSFET is coupled to the second terminal of the third capacitor, and the source of the NMOSFET is coupled to the grounding terminal;

wherein the step of sensing the variation of the output voltage to selectively control the output voltage further comprises:

when the output voltage abruptly increases, utilizing the third capacitor to couple the output voltage to the gate of the NMOSFET, and utilizing the NMOSFET to obtain the other instant current from the output terminal of the voltage regulator module and release the other instant current to the grounding terminal, to reduce the increment of the output voltage.

* * * * *